US005570522A

United States Patent [19]

Olson et al.

[11] Patent Number: 5,570,522

[45] Date of Patent: Nov. 5, 1996

[54] IN-LINE SKATE WITH AN ADJUSTABLE FASTENER AND STRAP

[75] Inventors: Todd J. Olson, Chanhassen; Dirk L. Cornelius, Oakdale; Lloyd G. Keleny, Champlin, all of Minn.

[73] Assignee: Rollerblade, Inc., Minneapolis, Minn.

[21] Appl. No.: 488,186

[22] Filed: Jun. 7, 1995

[51] Int. Cl.[6] ..... A43B 5/16; A43B 5/04

[52] U.S. Cl. ..... 36/50.5; 36/115

[58] Field of Search ..... 36/50.1, 50.5, 36/117–121, 115, 51; 24/68 SK, 70 SK, 69 SK, 71 SK

[56] References Cited

U.S. PATENT DOCUMENTS

| | | | |
|---|---|---|---|
| 177,396 | 5/1876 | Harris . | |
| D. 300,049 | 2/1989 | Klamer et al. . | |
| D. 324,937 | 3/1992 | Cavasin . | |
| 758,366 | 4/1904 | Johnson . | |
| 3,163,900 | 1/1965 | Martin | 36/50.5 |
| 3,491,465 | 1/1970 | Martin | 36/50.1 |
| 3,545,106 | 12/1970 | Martin | 36/50.1 |
| 3,570,148 | 3/1971 | Morgan . | |
| 3,975,838 | 8/1976 | Martin | 36/50.1 |
| 4,150,500 | 4/1979 | Delery . | |
| 4,360,979 | 11/1982 | Spademan . | |
| 4,408,403 | 10/1983 | Martin . | |
| 4,477,949 | 10/1984 | Calabro . | |
| 4,761,898 | 8/1988 | Courvoisier et al. . | |
| 4,823,484 | 4/1989 | Couty . | |
| 5,129,130 | 7/1992 | Lecouturier . | |
| 5,226,246 | 7/1993 | Soo . | |
| 5,251,388 | 10/1993 | Pozzobon et al. . | |
| 5,291,671 | 3/1994 | Caberlotto et al. . | |
| 5,317,820 | 6/1994 | Bell et al. . | |
| 5,397,141 | 3/1995 | Hoshizaki et al. . | |
| 5,535,483 | 10/1994 | Louviere . | |

FOREIGN PATENT DOCUMENTS

| | | | |
|---|---|---|---|
| 0349943 | 1/1990 | European Pat. Off. . | |
| 1115248 | 4/1956 | France | 36/50.5 |
| 1410184 | 7/1965 | France . | |
| 2946522 | 5/1981 | Germany . | |
| 4222326 | 2/1992 | Germany . | |
| 9208063 | 10/1992 | Germany . | |

*Primary Examiner*—B. Dayoan

*Attorney, Agent, or Firm*—Merchant, Gould, Smith, Edell, Welter & Schmidt

[57] ABSTRACT

An in-line skate has a fastening system which includes a strap having a first end and a second end each secured to a same side of the skate. A buckle is provided for releasably securing one of the first and second ends to the side. A first fastening member is secured to the strap at a point between the first and second ends. A second fastening member is secured to the boot on a side opposite the side on which the strap ends are fastened. The first and second fastening members may be releasably joined and tensioned.

13 Claims, 5 Drawing Sheets

IN-LINE SKATE WITH AN ADJUSTABLE FASTENER AND STRAP

I. BACKGROUND OF THE INVENTION

1. Field of the Invention

This invention pertains to skates. More particularly, this invention pertains to a novel buckle arrangement for such a skate.

2. Description of the Prior Art

In-line skates have enjoyed tremendous popularity. Such skates typically include a plastic boot secured to a frame. A plurality of wheels are rotatably mounted on the frame.

Commonly, the boot of an in-line skate is a front entry boot. In other words, the boot has sidewalls with a spacing between the sidewalls on the front of the boot. The spacing permits a user to insert his foot into the boot. Frequently, such boots are also provided with liners to provide cushioning and comfort between the foot and the walls of the plastic boot. Also, a tongue may be provided to fill the spacing between the sidewalls of the boot.

To secure the boot onto the user's foot, a wide variety of fastening devices have been used in the prior art to draw the opposing sides of the boot together. For example, lacing has been used to fasten the boot. Also, a wide variety of buckles have been used either alone or in combination with lacing. Such buckles may include one end secured to one side of the boot and the other end releasably secured to the other side of the boot. Frequently, such buckle arrangements permit a buckle end to be secured to one side of the boot and a tensioning mechanism to tension the buckle strap to fully secure the boot onto a user's foot. With this arrangement, a user can remove the boot simply by releasing the tensioning mechanism without fully releasing the buckle strap.

In such prior art devices, numerous buckles would be used on a boot or one or more buckles would be used in combination with lacing. Accordingly, a user had to manipulate several different fastening mechanisms in order to remove or attach a skate. In addition to being inconvenient for most users, a multiple buckle or fastener arrangement was particularly difficult for children attempting to put on or take off skates on their own without adult assistance.

II. SUMMARY OF THE INVENTION

According to a preferred embodiment of the present invention, a skate is disclosed which includes a boot having a plurality of wheels secured to the boot. The boot has left and right sides with an open space defined there between. A strap has a first end and a second end each secured to a same one of the boot's sides. A buckle is provided for releasably securing one of the first and second ends to the side of the boot. A first fastener member is secured to the strap at a point between the first and second ends. A second fastener member is secured to the boot on a side thereof opposite the side to which the first and second ends of the strap is secured. The first and second fastener members may be interlocked to releasably join the first and second fastener members.

III. BRIEF DESCRIPTION OF THE DRAWINGS

IV. DESCRIPTION OF THE PREFERRED EMBODIMENT

Figure 1:
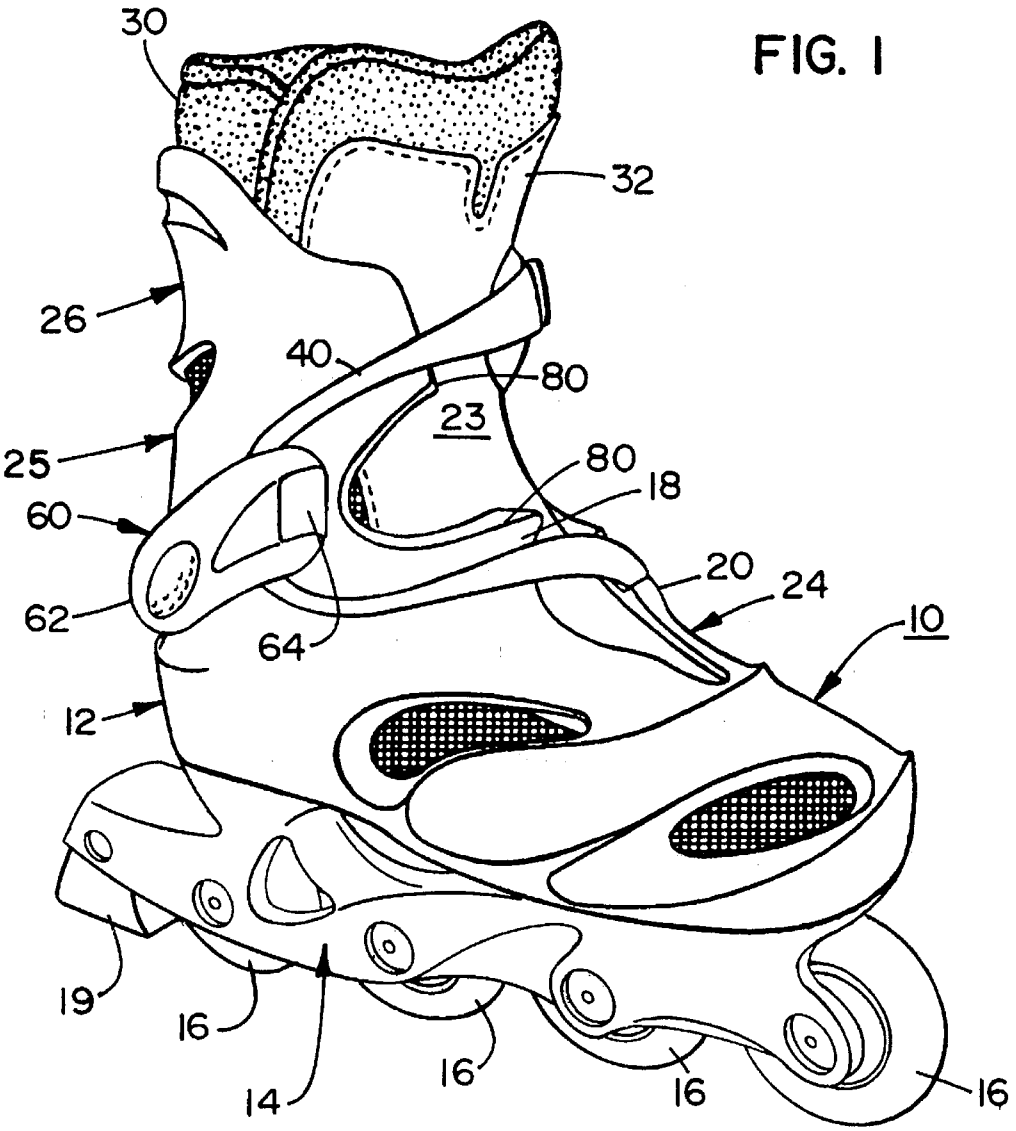
FIG. 1 is a front, top and right side perspective view of an in-line skate having a fastener arrangement according to the present invention.

With reference now to the several drawing figures in which identical elements are numbered identically throughout, a description of the preferred embodiment to the present invention will now be provided. With initial reference to FIGS. 1–7, an in-line skate 10 is shown having a boot 12 secured to a frame 14. The frame 14 carries a plurality of wheels 16 each rotatably mounted in the frame 14 and with the wheels disposed in a linear arrangement with the axles of the wheels in parallel alignment. A rear end of the frame 14 carries a brake pad 19 as is conventional.

The boot 12 is molded plastic and includes a right side 18 and a left side 20. The right and left sides 18, 20 are joined by a solid heel portion 25 but are spaced apart in the front of the boot to define an open space 22 between the right and left sides 18, 20.

The boot 12 is shaped to present an instep portion 24 and a cuff portion 26. The instep portion 24 is sized to receive the instep area of a wearer's foot. The cuff portion 26 extends upwardly from the instep portion 24 and is sized to surround a lower leg of a wearer. The opening 23 extends from the instep portion 24 completely through the cuff portion 26. As is conventional, a cushioned liner 30 is received within the boot and a tongue 32 is provided to be received within the interior boot spanning the opening 23.

The present invention is directed to a novel fastening means for drawing the right and left sides 18, 20 toward one another to securely fasten the boot 12 to a foot of a wearer. The novel fastening mechanism includes a flexible strap 40 which is generally resistent to stretching along its length. The strap 40 extends from a first end 42 (FIG. 8) to a second end 44. The first end 42 is secured to the left side 20 of the boot 12 through any suitable means such as a rivet 46 or the like. It will be appreciated that the boot in skate 10 shown in the drawings is to be worn on the right foot of a wearer and accordingly, the ends 42, 44 of the strap 40 are shown fastened to the left side which is the inside of the skate. For a boot to be worn on the left foot, the ends 42, 44 would be fastened to the right side of the boot.

Figure 8:
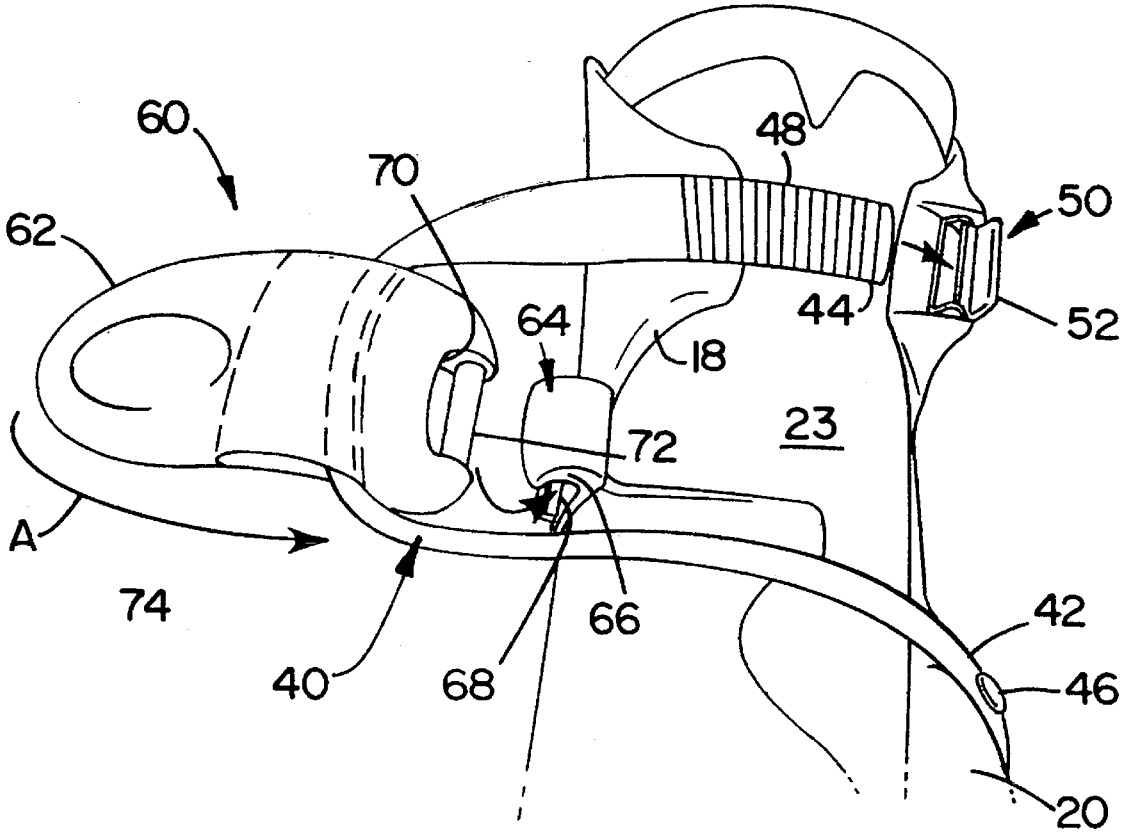
FIG. 8 is a front elevation view of an upper portion of the skate of FIG. 1 showing a buckle arrangement in an unfastened position.

A buckle 50 is provided for securing end 44 of the strap 40 to the left side 20 of the boot 12. As best shown in FIG. 8, end 44 of strap 40 is provided with a plurality of toothed notches 48. The buckle 50 is selected to grasp end 44 at any one of the notches 48 and to secure the strap 40 to the buckle 50 at that position. Further, the buckle 50 is selected to be released such that the end 44 may be completely removed from the buckle 50. Buckle 50 is provided with a tab 52 which may be depressed by a user to release end 44 from the grasp of buckle 50. Tab 52 is spring loaded to a locked position where it securely grasps end 44 at any one of the locations of notches 48. It will be appreciated that buckles such as buckle 50 are well known in the art and form no part of this invention per se. For aesthetic purposes, the end 44 passes through buckle 50 into a cavity formed in the left side. Accordingly, in the view of FIG. 3, the free end 44 is not shown.

A second buckle 60 includes a first fastener member 62 and a second fastener member 64. The second fastener member is secured to the right side 18 of the boot 12 through any suitable means such as rivets or the like. The second fastener member 64 includes a hook end 66 which is turned to present a pocket 68.

The first fastener member 62 includes an end having a relief 70. A rod 72 is positioned within the relief 70. The rod 72 is sized to be received within the pocket 68 such that the combination of the pocket 68 and the rod 72 define a pivot point about Which the first fastener member 62 may pivot.

The first fastener member 62 has an opening 74 formed therethrough in a direction generally parallel to the rod 72. The opening 74 is sized to freely pass the strap 40 (as shown in phantom lines in FIG. 8). The opening 74 is positioned such that the strap 40 within the opening 74 is generally parallel to and spaced from rod 72.

The clip or second fastener member 64 is positioned on side 18 approximately mid-point between ends 42 and fastener 50.

With the structure thus described, a user may insert end 44 within buckle 50 such that end 44 is captured by buckle 50. The user then places rod 72 within pocket 68 and rotates the member 62 in the direction of arrow A in FIG. 8 such that the member 62 fully rests against side 18 as shown in FIGS. 1–7. The rotating action of buckle member 62 against side 18 causes a tensioning effect on strap 40 to draw sides 18, 20 together. Further, with the structure thus described, buckle 62 is an over-center locking mechanism which stays in place after it has been placed against the side 18. When it is desired to remove the skate 10, the user rotates the buckle member 62 in a direction opposite of arrow A. This releases the tensioning on strap 40. When the tension on strap 40 is released, the rod 72 may be removed from pocket 68 such that the sides 18, 20 may be freely flexed apart to permit removal of the foot from the skate boot 12. Buckle 50 permits end 44 to be positioned in any one of a plurality of locations such that a desired tension is achieved when buckle 62 is put in place.

Figure 2:
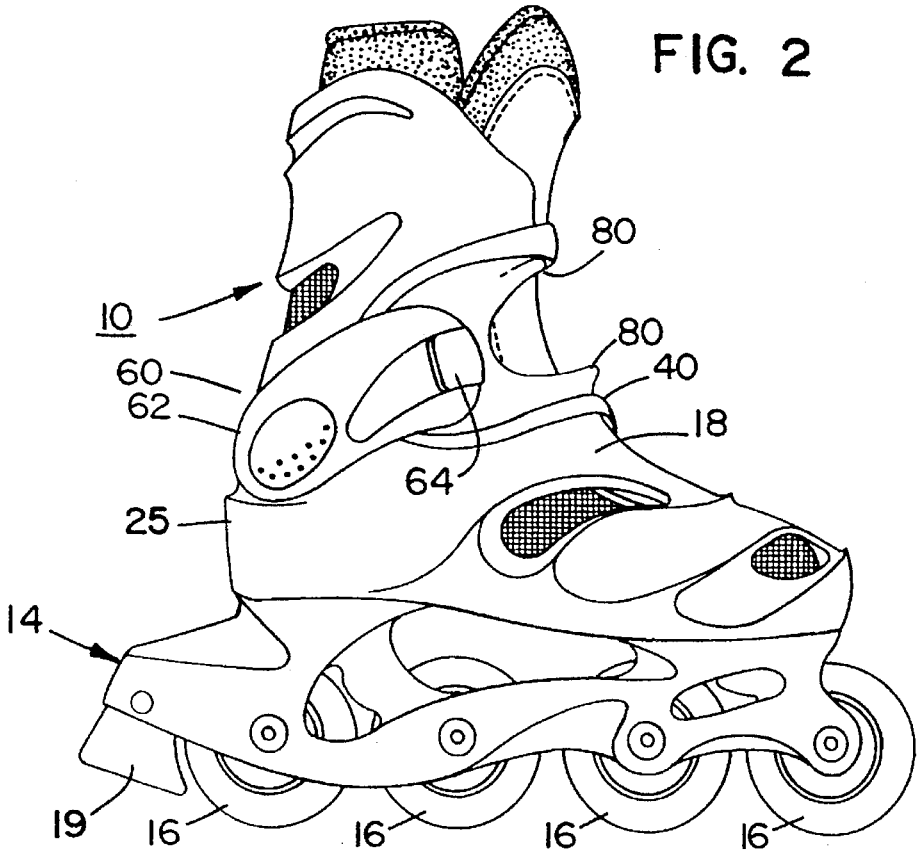
FIG. 2 is a right side elevation view of the skate of FIG. 1.
Figure 3:
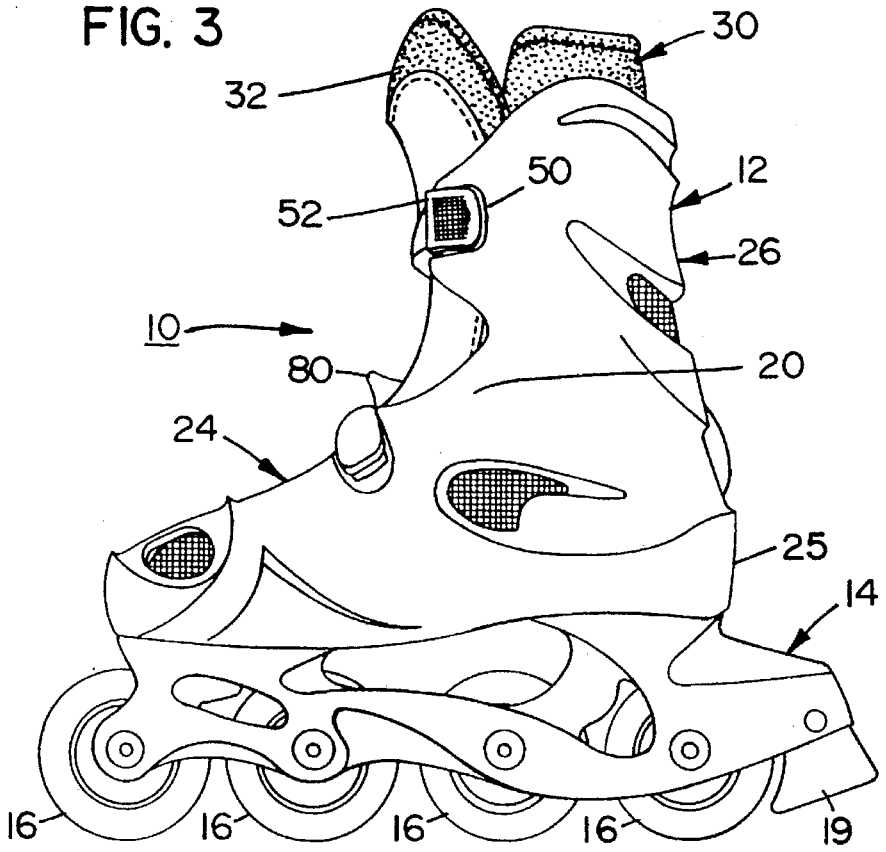
FIG. 3 is a left side elevation view of the skate to FIG. 1.
Figure 4:
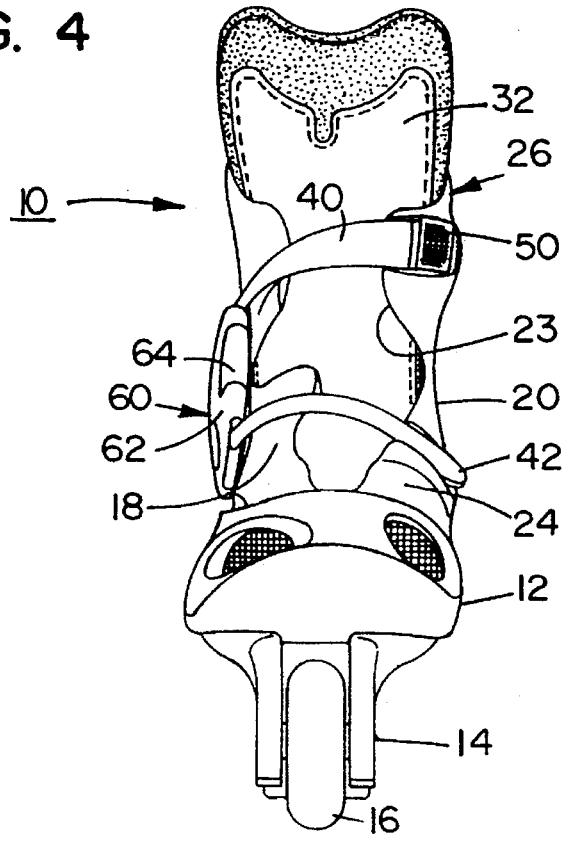
FIG. 4 is a front elevation view of the skate of FIG. 1.
Figure 5:
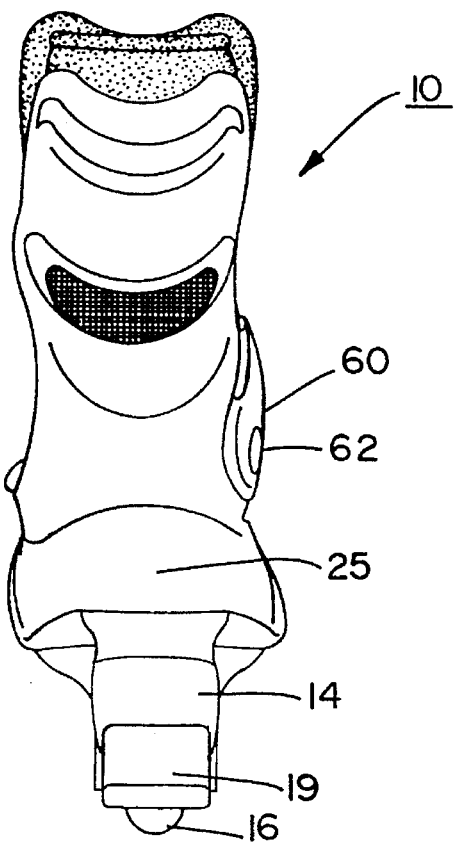
FIG. 5 is a rear elevation view of the skate of FIG. 1.
Figure 6:
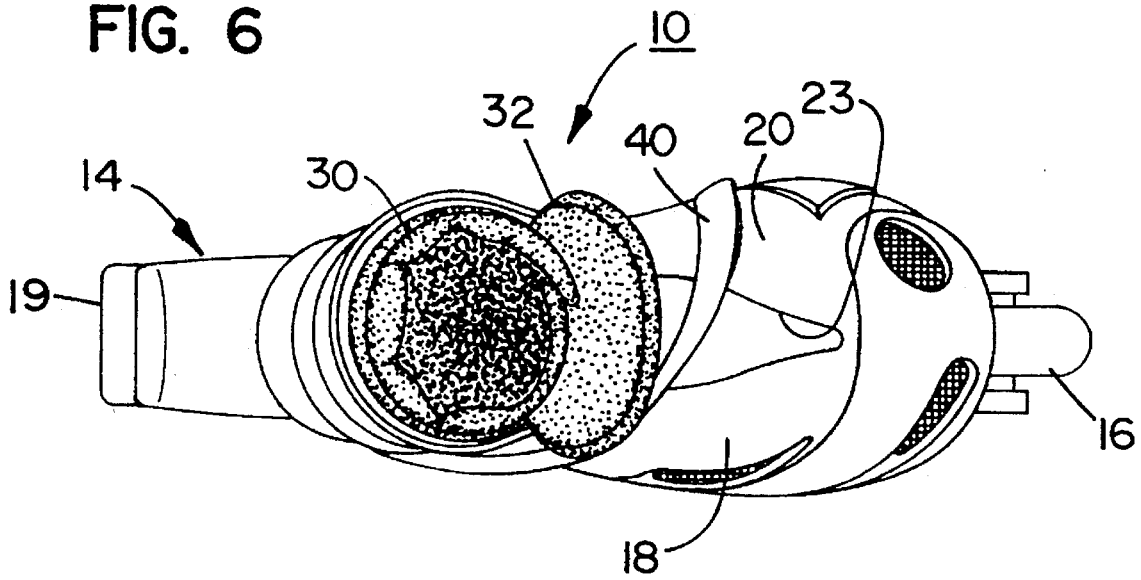
FIG. 6 is a top plan view of the skate of FIG. 1.
Figure 7:
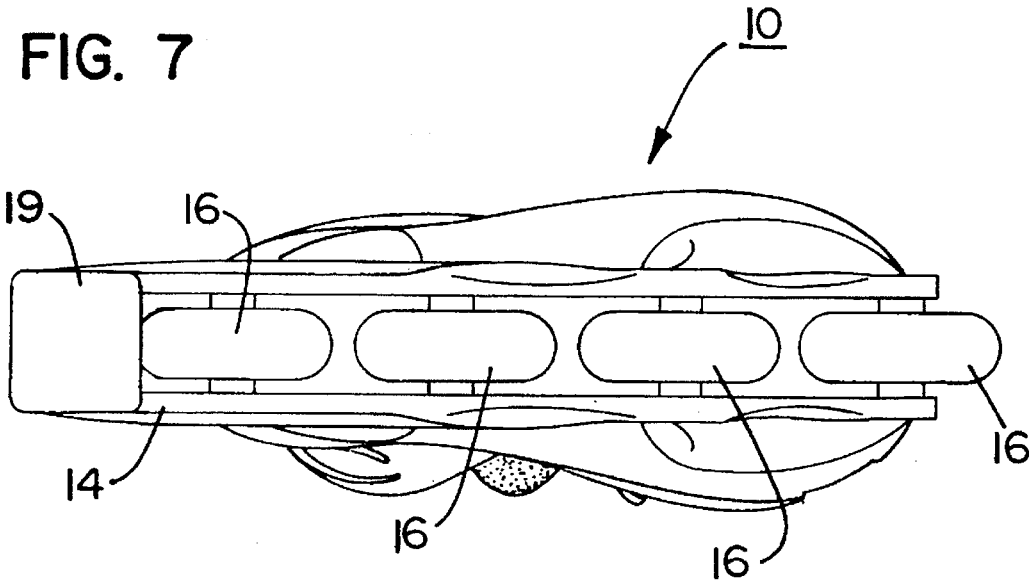
FIG. 7 is a bottom plan view of the skate of FIG. 1.

Shown best in FIGS. 2 and 3, side 18 includes raised areas 80 which define channels (or guide surfaces) into which the strap 40 is received to ensure that the strap 40 remains in a desired location. Also, as the end 44 of strap 40 is slid into or out of buckle 50 in any one of a desired locations along notches 48, the length of the strap 40 is reduced. The sliding movement of strap 40 within opening 74 permits the buckle member 62 to be repositioned along strap 40 such that the buckle member 62 remains aligned with second fastening member 64.

The foregoing detailed description of the present invention it has been shown how the objects of the invention have been attained in a preferred manner. With the present invention, an in-line skate is provided which has a single buckle 62 which needs to be tensioned or released to permit removal or placement of the skate 10 on a user's foot. Fine tuning of the tensioning of the boot on the foot is achieved through placement of notched end 44 within buckle 50. Accordingly, with the invention, a single fastening device is all that is required for securing the boot to a foot. With the present invention, a preferred embodiment has been shown with the ends 42 and 44 of the strap 40 fastened to the instep and cuff portions, respectively of the boot. An alternative embodiment is to have both of ends 42, 44 fastened to the instep area of the boot and with a separate buckle provided for the cuff.

Having disclosed the inventions in a preferred embodiment, it will be appreciated that the modifications and equivalents of the disclosed concepts such as those which readily occur to one skilled in the art are intended to be included within the scope of the claims intended hereto.

What is claimed is:

1. A skate comprising:

a boot including a cuff portion and an instep portion;

a plurality of wheels secured to said boot;

said boot including first and second sides with an open space defined therebetween;

a strap having a first end and a second end each secured to said first side, said first end secured to said first side in said cuff portion of said boot at a first point of attachment and said second end secured to said first side in said instep portion of said boot at a second point of attachment;

a buckle for releasably securing one of said first and second ends to said first side at one of said first and second points of attachment;

a first fastener member secured to said strap at a generally mid-point thereof between said first and second ends;

a second fastener member secured to said boot on said second side;

said first and second fastener members each including locking means for releasably joining said first and second fastener members to define a third point of attachment on said second side;

said strap secured to said boot at only said first, second and third points of attachment;

said first fastener member movable between a latch position and an unlatch position relative to said second fastener member, said first fastener member tensioning said strap upon movement of said first fastener member to said latch position; and said first and second fasteners members being completely separable when said first fastener member is in said unlatch position for said strap to be moved to provide an access through said open space unobstructed by said strap;

whereby upon movement of said first fastener member to said latch position both of said first and second sides at both of said cuff portion and said instep portion are drawn together to narrow said open space and snugly secure said boot to a user.

2. A skate comprising:

a boot including a cuff portion and an instep portion;

a plurality of wheels secured to said boot;

said boot including first and second sides with an open space defined therebetween;

a strap having a first end and a second end each secured to said first side, said first end secured to said first side at a first point of attachment and said second end secured to said first side at a second point of attachment;

a buckle for releasably securing one of said first and second ends to said first side;

a first fastener member secured to said strap at a generally mid-point thereof between said first and second ends;

a second fastener member secured to said boot on said second side;

said first and second fastener members each including locking means for releasably joining said first and second fastener members;

said first fastener member movable between a latch position and an unlatch position relative to said second fastener member, said first fastener member tensioning said strap upon movement of said first fastener member to said latch position;

whereby upon movement of said first fastener member to said latch position both of said first and second sides are drawn together to narrow said open space and snugly secure said boot to a user; and said locking means includes means for said first fastener member to move from said unlatch position to said latch position with said strap tensioned as said first fastener member moves to said latch position;

said strap secured to said boot at only said first, second and third points of attachment;

said first fastener member completely detachable from said second fastener member when said first fastener member is in said unlatch position.

3. A skate according to claim 2 wherein said first and second fastener members cooperate to define an over-center lock.

4. A skate comprising:

a boot including a cuff portion and an instep portion;

a plurality of wheels secured to said boot;

said boot including first and second sides with an open space defined therebetween;

a strap having a first end and a second end each secured to said first side at first and second points of attachment;

a buckle for releasably securing one of said first and second ends to said first side;

a first fastener member secured to said strap at a generally mid-point thereof between said first and second ends;

a second fastener member secured to said boot on said second side at a third point of attachment;

said first and second fastener members each including locking means for releasably joining said first and second fastener members;

said first fastener member movable between a latch position and an unlatch position relative to said second fastener member, said first fastener member tensioning said strap upon movement of said first fastener member to said latch position;

whereby, upon movement of said first fastener member to said latch position, both of said first and second sides at both of said cuff portion and said instep portion are drawn together to narrow said open space and snugly secure said boot to a user; and said buckle including means for securing said one of said first and second ends at any one of a plurality of locations along said strap at said one of said first and second sides.

5. A skate according to claim 1 wherein said first fastener member is movable along said strap.

6. A skate comprising:

a boot including a cuff portion and an instep portion; a plurality of wheels secured to said boot;

said boot including first and second sides with an open space defined therebetween;

a strap having a first end and a second end each secured to said first side, said first end secured to said first side in said cuff portion at a first point of attachment and said second end secured to said first side in said instep portion at a second point of attachment;

a buckle for releasably securing one of said first and second ends to said first side;

a first fastener member secured to said strap at a generally mid-point thereof between said first and second ends;

a second fastener member secured to said boot on said second side at a third point of attachment;

said first and second fastener members each including locking means for releasably joining said first and second fastener members;

said strap secured to said boot at only said first, second and third points of attachment;

said first fastener member movable between a latch position and an unlatch position relative to said second fastener member with said first fastener member tensioning said strap upon movement of said first fastener member to said latch position;

whereby upon movement of said first fastener member to said latch position both of said first and second sides at both of said cuff portion and said instep portion are drawn together to narrow said open space and snugly secure said boot to a user; and one of said sides of said boot includes an upper guide surface and a lower guide surface, said upper guide surface and said lower guide surface defining respective channels for receiving said strap when said first fastener member and said second fastener member are joined.

7. A skate comprising:

a boot including a cuff portion and an instep portion;

a plurality of wheels secured to said boot;

said boot including first and second sides with an open space defined therebetween;

a strap having a first end and a second end each secured to said first side, said first end secured to said first side in said cuff portion at a first point of attachment and said second end secured to said first side in said instep portion of said boot at a second point of attachment;

a buckle for releasably securing one of said first and second ends to said same one of said sides;

a first fastener member secured to said strap at a generally mid-point thereof between said first and second ends;

a second fastener member secured to said boot on said second side at a third point of attachment;

said first and second fastener members each including locking means for releasably joining said first and second fastener members;

said first fastener member movable between a latch position and an unlatch position relative to said second fastener member with said first fastener member tensioning said strap upon movement of said first fastener member to said latch position;

whereby upon movement of said first fastener member to said latch position both of said first and second sides at both of said cuff portion and said instep portion are drawn together to narrow said open space and snugly secure said boot to a user; and one of said first and second ends includes a plurality of toothed notches, each one of said toothed notches being securable to said buckle.

8. A skate comprising:

a boot;

a plurality of wheels secured to said boot;

said boot including first and second sides with an open space defined therebetween;

a strap having a first end and a second end each secured to said first side at first and second points of attachment, respectively;

a buckle for releasably securing one of said first and second ends to said second side at one of said first and second points of attachment;

a first fastener member secured to said strap at a generally mid-point thereof between said first and second ends, said first fastener member carried on said strap for movement therewith;

a second fastener member secured to said boot on said second side at a third point of attachment;

said first and second fastener members each including locking means for releasably joining said first and second fastener members, with said first fastener member completely detachable from said second fastener member;

said strap secured to said boot at only said first, second and third points of attachment;

said first fastener member movable between a latch position and an unlatch position relative to said second fastener member with said first fastener member tensioning said strap upon movement of said first fastener member to said latch position; and said first fastener member detachable from said second fastener member when said first fastener member is in said unlatch position for access through said opening to be unobstructed by said strap.

9. A skate according to claim 8, wherein said first fastener member is movable along said strap.

10. A skate comprising:

a boot including a cuff portion and an instep portion;

a plurality of wheels secured to said boot;

said boot including first and second sides with an open space defined therebetween;

a strap having a first end and a second end each secured to said first side, said first end secured to said first side in said cuff portion of said boot and said second end secured to said second side in said instep portion of said boot, one of said first and second ends having a plurality of toothed notches;

a buckle for releasably securing said one of said first and second ends to said first side, said buckle having a plurality of toothed notches at a notch thereof positioned opposing said buckle, said strap slidable relative to said buckle so that any desired one of said notches can be positioned opposing said buckle;

a first fastener member secured to said strap at a generally mid-point thereof between said first and second ends, said first fastener member being movable along said strap;

a second fastener member secured to said boot on said second side;

said first and second fastener members each including locking means for releasably joining said first and second fastener members; and said first fastener member movable between a latch position and an unlatch position;

whereby said strap is tensioned to tighten the boot upon movement of said first fastener member into said latch position and the degree of tensioning is separately and independently adjustable by said buckle.

11. A skate according to claim 1, 6 or 8 wherein said buckle includes means for securing said one of said first and second ends at any one of a plurality of locations along said strap at said one of said first and second sides.

12. A skate according to claim 2, 4, 6, 7 or 8 wherein said first fastener member is slidable along a length of said strap.

13. A skate according to claim 2 wherein said first end of said strap is secured at said cuff portion and wherein said second end is secured at said instep portion.

* * * * *